US008182327B2

(12) United States Patent
Szrek et al.

(10) Patent No.: US 8,182,327 B2
(45) Date of Patent: May 22, 2012

(54) MANAGEMENT OF OUTCOMES OF GAMES OF CHANCE

(76) Inventors: Walter Szrek, East Greenwich, RI (US); Irena Szrek, East Greenwich, RI (US)

( * ) Notice: Subject to any disclaimer, the term of this patent is extended or adjusted under 35 U.S.C. 154(b) by 674 days.

(21) Appl. No.: 12/274,897

(22) Filed: Nov. 20, 2008

(65) Prior Publication Data

US 2009/0131140 A1 May 21, 2009

Related U.S. Application Data

(60) Provisional application No. 60/989,652, filed on Nov. 21, 2007.

(51) Int. Cl.
*A63F 9/24* (2006.01)

(52) U.S. Cl. ..... 463/17; 463/1; 463/16; 463/26; 463/27

(58) Field of Classification Search ..... 463/20, 463/25–27

See application file for complete search history.

(56) References Cited

U.S. PATENT DOCUMENTS

| | | | | |
|---|---|---|---|---|
| 2003/0036427 | A1 | 2/2003 | Brandstetter et al. | |
| 2006/0079311 | A1 | 4/2006 | Nulph | |
| 2006/0178194 | A1 * | 8/2006 | Jubinville et al. | 463/17 |
| 2009/0131140 | A1 * | 5/2009 | Szrek et al. | 463/17 |
| 2009/0227318 | A1 * | 9/2009 | Wright et al. | 463/17 |
| 2010/0029362 | A1 * | 2/2010 | Bennett et al. | 463/17 |
| 2010/0144417 | A1 * | 6/2010 | Wright et al. | 463/17 |

OTHER PUBLICATIONS

International Search Report and Written Opinion, Application No. PCT/US2008/084411, dated Jul. 9, 2009, 11 pages.

* cited by examiner

*Primary Examiner* — Minhloan T Tran
*Assistant Examiner* — William Harriston
(74) *Attorney, Agent, or Firm* — Armstrong Teasdale LLP

(57) ABSTRACT

A method and system is provided for managing the outcomes of games of chance while maintaining the game's integrity.

18 Claims, 9 Drawing Sheets

FIG. 6

| | | | |
|---|---|---|---|
| Bit 1 | **1** | Combination 1 | 1,2,3,4,5,6 – wagered |
| Bit 2 | **1** | Combination 2 | 1,2,3,4,5,7 – wagered |
| Bit 3 | **0** | Combination 3 | 1,2,3,4,5,8 – not wagered |
| Bit 4 | **1** | Combination 4 | 1,2,3,4,5,9 – wagered |
| … | | | |
| Bit M | **0** | Combination M | 1,2,3,4,6,7 – not wagered |
| … | | | |
| Bit P | **0** | Combination P | 9,10,11,12,13,14 – not wagered |
| … | | | |
| Bit R | **1** | Combination R | 10,11,12,13,14,15 – wagered |
| … | | | |
| Bit L | **1** | Combination L | 44,45,46.47,48, 49 - wagered |

FIG. 7

| | | | |
|---|---|---|---|
| Bit 1 | **1** | Combination 1 | 1-st wagered combination |
| Bit 2 | **1** | Combination 2 | 2-nd wagered combination |
| Bit 3 | 0 | | |
| Bit 4 | **1** | Combination 4 | 3-rd wagered combination |
| … | | | |
| Bit M | 0 | | |
| … | | | |
| Bit P | 0 | | |
| … | | | |
| **Bit R** | **1** | **Combination R** | **k-th wagered combination** |
| … | | | |
| Bit L | **1** | Combination L | n-th (last) wagered combination |

FIG. 8

| | | | |
|---|---|---|---|
| Bit 1 | 1 | | |
| Bit 2 | 1 | | |
| Bit 3 | **0** | Combination 3 | 1-st not set bit |
| Bit 4 | 1 | | |
| … | | | |
| **Bit F** | **0** | **Combination F** | **k-th not set (zero) bit =>winning combination** |
| … | | | |
| Bit M | **0** | Combination M | not set bit |
| … | | | |
| Bit P | **0** | Combination P | not set bit |
| … | | | |
| Bit R | 1 | | |
| … | | | |
| Bit L | 1 | | |

MANAGEMENT OF OUTCOMES OF GAMES OF CHANCE

BACKGROUND

Some games of chance involve the combining of a lottery game and a traditional raffle game. In these games, a raffle game is provided as an add-on game to the lottery game. Each transaction has a unique raffle number associated with it. For the raffle game draw a unique raffle number is randomly "drawn." This number becomes a winning indicia, and the transaction marked with this number becomes the winner. In this game, the raffle game add-on is triggered based on some well-defined criteria such as numbers repeating in the base lottery game. Therefore, without a trigger, there is no draw for the raffle game.

Some games of chance have players competing for a jackpot or top prize. If there is no winner in the top prize category, the pool of money accumulated for that prize category is carried over to the next draw. This type of game generally has low odds of winning a jackpot prize. When the coverage of all bet combinations played is fairly low, the top prize may not be won often enough, and players may lose interest in the game.

In other games of chance different from the previous games, the coverage of all combinations played is very high and the jackpot is won very often, but the prize amount is not allowed to increase to a substantially high enough amount and the people again may lose interest in playing the game.

Within a specific game type, a game provider cannot control the frequency of the jackpot winnings (e.g., whether they are too often or too seldom) without changing the game matrix. But changing the matrix of the game is not always desirable as it may require added expenses: resolving game logistical issues, and educating both retailers and the public about the game change. There is also no guarantee that the players will accept the game with a new matrix. For some games, it is desirable to reduce the odds or to ensure a jackpot winner from time to time. For other games, it may be desirable to reduce frequency of jackpot winning to produce higher prizes. Game designer and gaming organizations would like to have control over winning jackpot games, while preserving the games' integrity.

BRIEF DESCRIPTION

In one aspect, a method for conducting draws for a jackpot game is provided. The method includes identifying a plurality of draw types for the jackpot game. The plurality of draw types includes two or more of a traditional draw, a raffle-combination draw, and a raffle-non-win combination draw. The method also includes selecting, based on at least one or more selection criteria, a first one of the identified plurality of draw types for a first draw of the jackpot game. The selected first one of the identified plurality of draw types is applied during the first draw of the jackpot game. The method further includes selecting, based at least on one or more of the selection criteria, a second one of the identified plurality of draw types for a next draw for the jackpot game. The selected second one of the identified plurality of draw types is applied during the subsequent independent draw of the jackpot game. The first one and the second one correspond to the same or different draw types.

In another aspect, a system for conducting draws for a jackpot game is provided. The system includes a memory area for storing a plurality of draw types for the jackpot game. The plurality of draw types includes two or more of the following: a traditional draw, a raffle-combination draw, and a raffle-non-win combination draw. The system further includes a processor configured to select, based at least on one or more selection criteria, a first one of the identified plurality of draw types for a first draw for the jackpot game, wherein the selected first one of the identified plurality of draw types is applied during the first draw of the jackpot game, and select, based at least on one or more of the selection criteria, a second one of the identified plurality of draw types for a second draw for the jackpot game, wherein the selected second one of the identified plurality of draw types is applied during the second draw of the jackpot game, wherein the first one and the second one correspond to the same or different draw types.

In yet another embodiment, a method for conducting a raffle or raffle-combination draw in a multi-jurisdiction lottery game, with the multi-jurisdiction lottery game occurring in a plurality of jurisdictions, is provided. The method includes randomly selecting jurisdictional data for the lottery game in proportion to one or more of the following: sales of the lottery game in each of the jurisdictions, a quantity of lottery game transactions in each of the jurisdictions, and bet combination coverage in each of the jurisdictions. The method further includes applying the selected jurisdictional data during performance to perform raffle or raffle combination draw, and applying winning indicia from the selected jurisdiction to plurality of the jurisdictions.

In another aspect, a method for conducting a raffle-combination draw in a multi-jurisdiction lottery game, with the multi-jurisdiction lottery game occurring in a plurality of jurisdictions, is provided. The method includes receiving 102 bet combination data from at least two of the jurisdictions, merging 104 the received bet combination data, and conducting 106 the raffle-combination draw during based on the merged bet combination data.

BRIEF DESCRIPTION OF THE DRAWINGS

FIG. 6 is an example view of a bit table of bet combinations for lotto 6/49.

FIG. 7 is an example view of a selection of a raffle-win combination draw.

FIG. 8 is an example view of a selection of a raffle-non-win combination draw.

Corresponding reference characters indicate corresponding parts throughout the figures.

DETAILED DESCRIPTION

Figure 1:
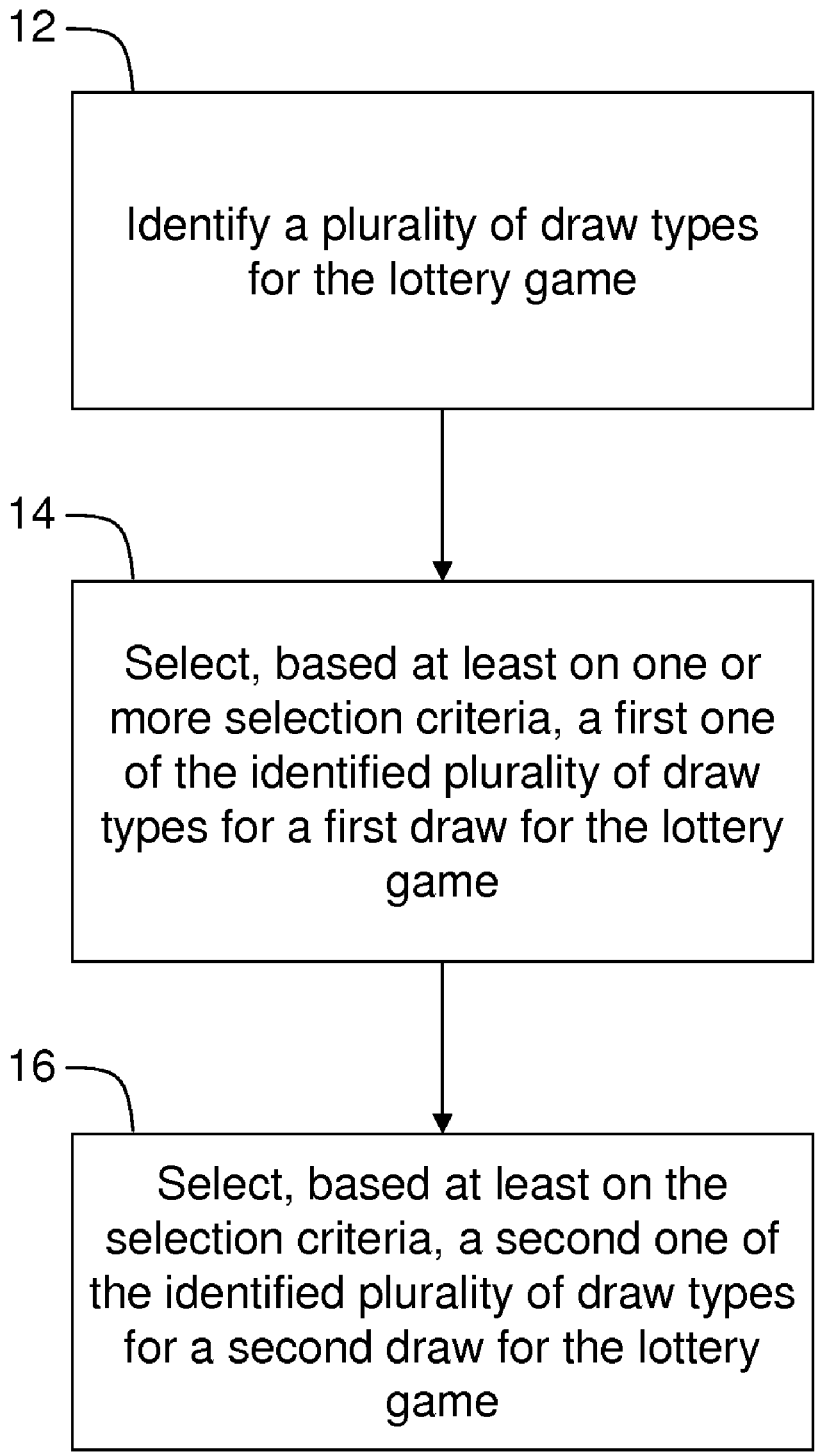
FIG. 1 is a flowchart of a method for conducting draws for a jackpot game.

Aspects of this invention are directed to drawing for games of chance. The drawing method allows for controlling probability that at least one wager wins the main prize while with the at least one jackpot winning wager the game matrix is maintained.

In traditional jackpot/lottery games, players choose the numbers from a well-defined range, e.g. 6/49 (six numbers out of the range 1 to 49). Some gaming environments may choose those numbers for the players. Once all players' transactions are gathered for a drawing, game provider uses a drawing machine to determine winning numbers. Such a machine will draw without bias a random set of numbers, e.g. six numbers out of the range 1 to 49.

There are also games guaranteeing top winners. One example of such game is a raffle game in which all sold tickets are combined together into a pool and winning tickets are randomly drawn from that pool. In these games each ticket has special unique game indicia, usually called raffle number. This traditional way of picking winners is often applied to games sold electronically by drawing a winner from all sold transactions, which are electronic records of tickets. However this method is good for some games where all tickets have different numbers or indicia. It is not a good method for games such as lotto where multiple tickets may have the same numbers.

For example, in a lotto game many players can wager the same bet combination (e.g. 4, 7, 13, 19, 32 and 37). In games where players pick their bet combinations, more popular combinations will be repeated more often than the less popular ones. As a result, if winners were picked by drawing a winner from all sold transactions, more popular bet combinations would have a higher chance to win from less popular. This method of drawing would not be good, as one of the key rules of jackpot/lottery games is fair play—every wager should have the same chance to win.

Referring to the figures, embodiments of the invention provide a method of managing the drawing for games of chance without changing the game matrix. In some embodiments, based on certain criteria, the drawing method chosen is one of a method guaranteeing a winner, a method with an unknown result regarding a winner, and a method guaranteeing there is not a winner.

More specifically, controlling the draws and jackpot winnings for games of chance involves the use of one of the draw types described below. One draw type is a "raffle-combination draw" that guarantees a jackpot winner. In a "raffle-combination draw" the raffle game concept is applied to all the bet combinations wagered or played, as opposed to all the bet combinations possible. A jackpot winning combination is then randomly drawn from the list of the unique bet combinations played. For example, if combination 4, 6, 11, 27, 36, 44 is wagered once and combination 2, 7, 23, 35, 37, 39 is wagered three times, the four bets are recorded as only two unique combinations. Therefore, the chance of drawing each combination from a unique set of combinations is the same. This draw type does not guarantee a single winner, but it guarantees at least one or more winners because every combination bet has the same chance to win, and only the combinations bet can win.

A second draw type is a "traditional draw" where any bet combination played can be a winner, but there is no guarantee that the winning bet combination will be played. Therefore, a traditional draw does not guarantee a jackpot winner, but can have at least one jackpot winner.

A third draw type is a "raffle-non-win-combination draw" guaranteeing there is no jackpot winner. In this draw type, a non-winning combination is randomly selected out of the list of all the non-bet combinations of all the possible combinations for the game.

The three draw types are discussed in more detail below.

FIG. 1 is a flowchart of a method for conducting draws for a jackpot game. A plurality of draw types are identified 12 for the jackpot game. The plurality of draw types includes two or more of a traditional draw, a raffle-combination draw, and a raffle-non-win combination draw. Based on at least one or more selection criteria, a first one of the identified plurality of draw types is selected 14 for a first draw of the jackpot game. The selected first one of the identified plurality of draw types is applied during the first draw of the jackpot game. Also, based at least on one or more of the selection criteria, a second one of the identified plurality of draw types for a next draw for the jackpot game is selected 16. The selection criteria used to select the first draw type may be the same or different from the selection criteria used to select the second draw type. The selected second one of the identified plurality of draw types is applied during the subsequent independent draw of the jackpot game. The first one and the second one correspond to the same or different draw types.

The selection criteria mentioned above includes at least one of an output from a random number generator according to a pre-determined probability, a predetermined frequency of each of the plurality of draw types, a predetermined winnings frequency, a predetermined sales level, a predetermined bet combinations coverage, input from a game organizer, a predetermined jackpot size, a predetermined marketing need, and a result of a sporting event or gaming event.

In one embodiment, an arbitrary way is chosen to decide a method of drawing. For example, a game provider may choose between traditional draw vs. a raffle-combination draw method. The game provider may decide that if for a certain number of consecutive draws there is no jackpot winner using the traditional drawing method, on a next draw a raffle-combination draw is held, therefore guaranteeing a jackpot winner. Another example would be if the jackpot amount reached the desired value, a raffle-combination draw would again be held to result in a jackpot winner. Yet another example is that an arbitrary decision may be made by a game provider to carry raffle-combination vs. traditional draw type at any time.

In some embodiments, a process, preferably using a specialized random number generation chooses with some desired probability a raffle-combination draw vs. a traditional draw. This process will be referred to as a "qualified-raffle" draw. This process may adjust the probability to take into account bet coverage. The formula to choose raffle-combination draw is: $p=(p\mathbf{1}-q)/(1-q)$, where p1 is a desired probability to draw a winner and q is a bets coverage ratio. For example, game provider may decide that in 30% of the cases traditional draw will be held. A qualifying-raffle process generates a random value between 1 and 100. If the values are from range 1 and 30, raffle-combination draw is held, for the values 31 to 100 traditional draw is held. In another example game provider wants to have a guaranteed winner in 30% of the draws and bet coverage is 10%. Raffle-combination draw is held when generated value is from range 1 and 22, otherwise traditional draw is held, as shown by: $p=(0.3-0.1)/(1-0.1)=0.22$. Various criteria may be used for a qualified-raffle draw.

Figure 2:
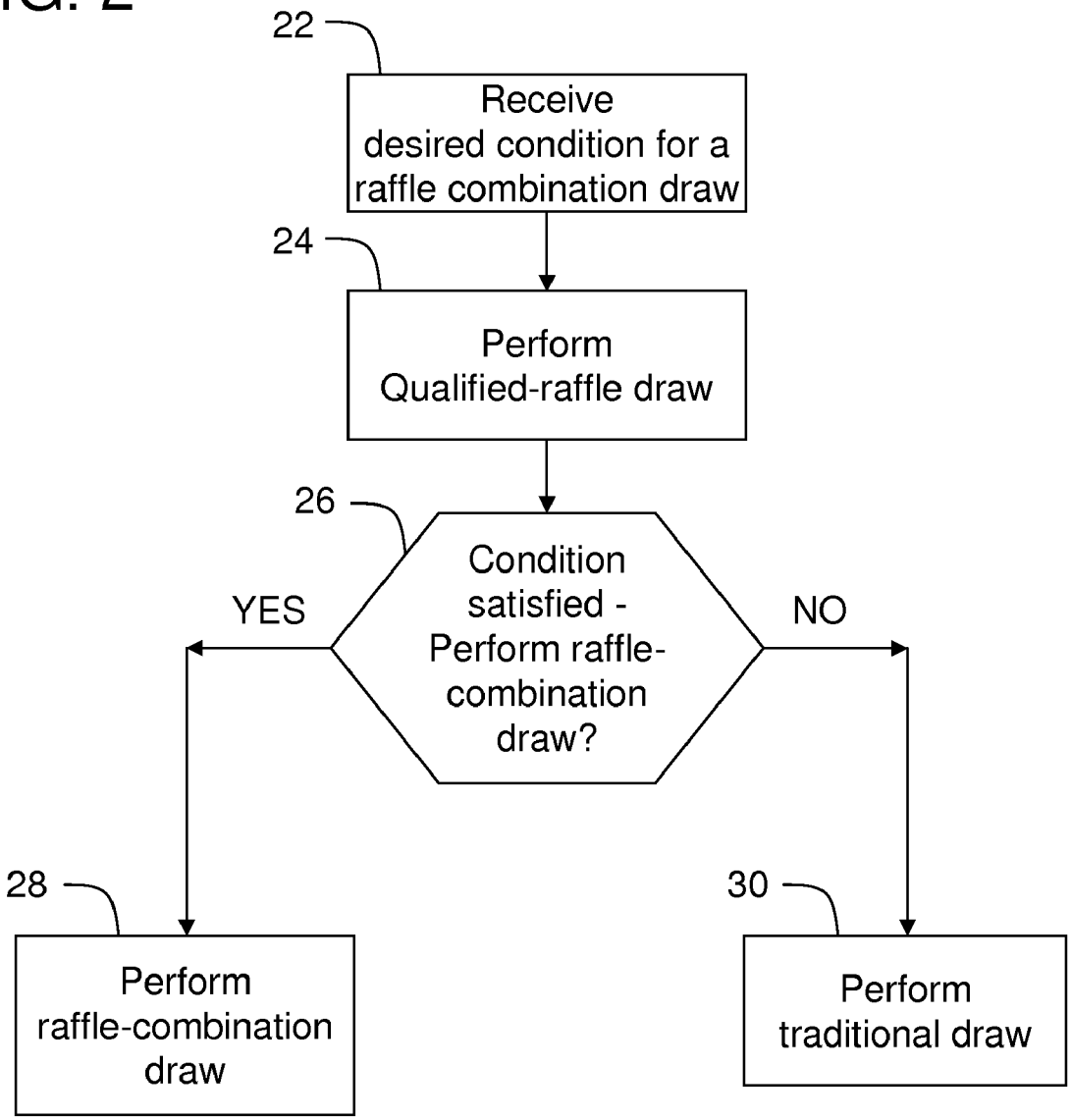
FIG. 2 is a diagram depicting an example qualified-raffle draw.

FIG. 2 is a diagram depicting an example qualified-raffle draw. In one embodiment, when the qualified raffle draw is executed, a desired condition for a raffle combination draw is received 22, and the qualified-raffle draw is performed 24. If the condition is satisfied 26, the raffle-combination draw is performed 28, and if the condition is not satisfied, the traditional draw is performed 30. Various criteria may be used for a qualified-raffle draw.

In another embodiment, the process chooses with a desired probability a raffle-combination drawing vs. raffle-non-win-combination drawing, drawing a combination that was not bet. Referring to FIG. 2 and using the same resulting conditions desired in the previous example, the same goal can be achieved differently. A random number 1-100 is generated. If the number generated falls in the range 1-30, raffle-combination draw is performed according to FIG. 3 (discussed below), if the number generated is from the range 31-100 raffle-non-win combination draw is performed according to FIG. 5 (discussed below). FIG. 4 (discussed below) and FIG. 5 (discussed below) depict two different types of draws that do not guarantee a winner: traditional draw and raffle-non-win draw.

In yet another embodiment, the process chooses with a desired probability traditional draw vs. raffle-non-win combination. This draw method is preferable for games generating jackpot winners more often than desired, and it works as long as there are some bet combinations that are not wagered. This process is either based on probability to choose traditional draw vs. raffle-non-win-combination draw, or based on a desired probability to draw a jackpot winner. For jackpot winner probability based draw qualification, a qualification process needs to take into account coverage of combinations bet. The formula to choose non-raffle draw is: $p=(q-p1)/q$, where p is probability to choose raffle-non-win combination draw, p1 is a desired probability to draw a winner and q is bets coverage ratio. For example for a game with 90% bet coverage and desired probability to have a winner 30% of time, raffle-non-win combination needs to be performed 67% times leaving 33% of the time that a traditional draw is performed. When using a random number generation for draw qualification, numbers 1 through 100 are generated. If numbers generated are from the range 1 through 67, raffle-non-win combination draw is performed. Otherwise traditional draw is performed.

Figure 3:
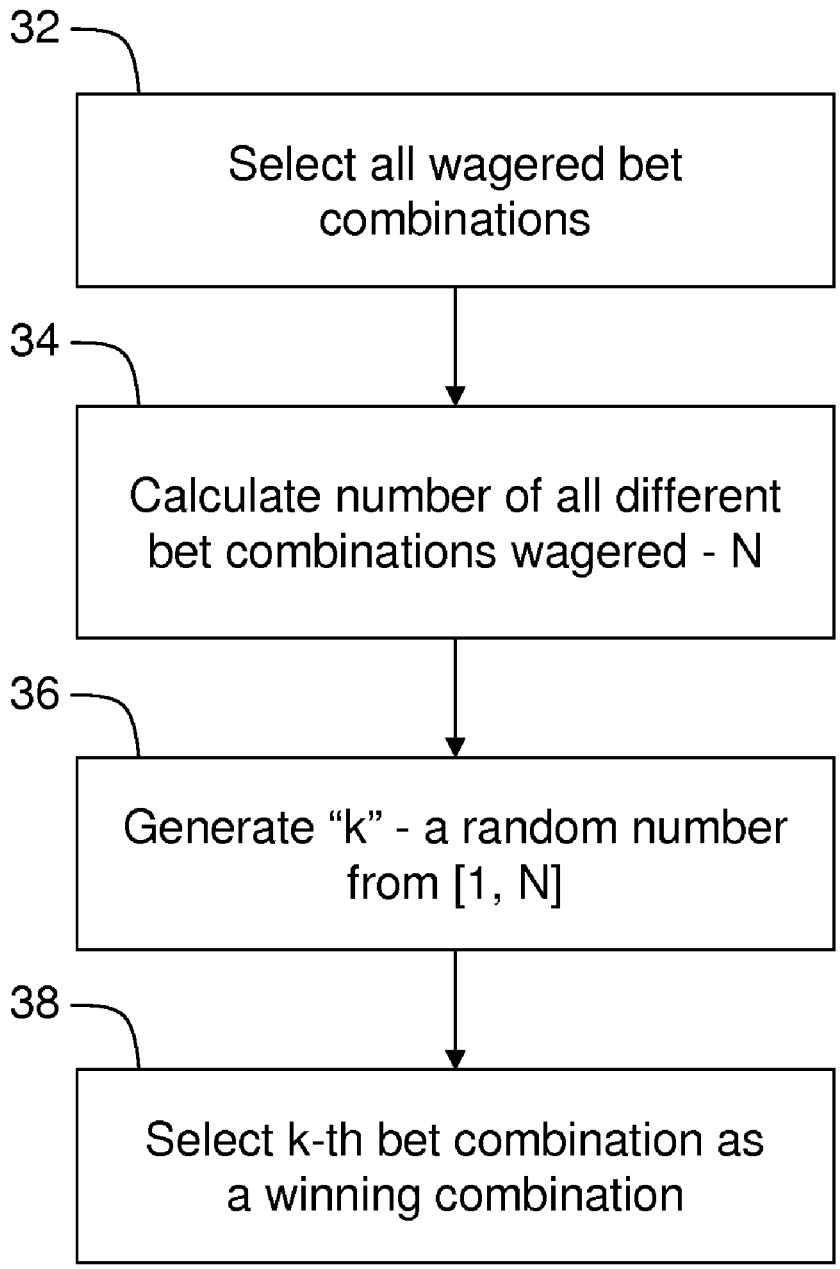
FIG. 3 is a flowchart illustrating a raffle-combination draw.
Figure 4:
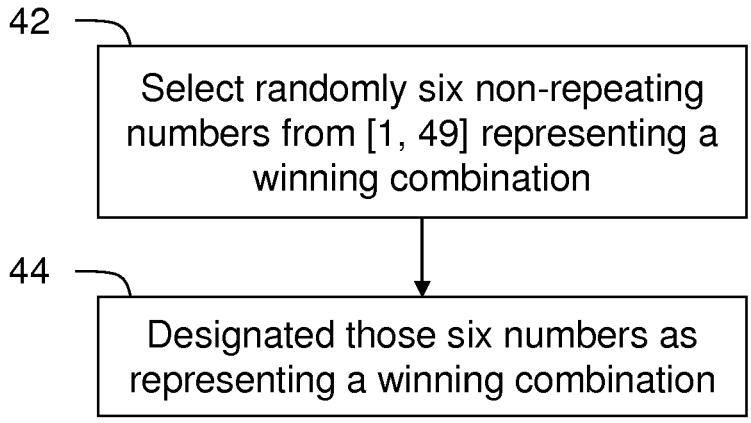
FIG. 4 is a flowchart illustrating a traditional draw.

FIG. 3 is a flowchart illustrating a raffle-combination draw. Various techniques may be used for creating raffle-combination draw. One example is a lotto game 6/49. In this example, after selecting all wagered bet combinations 32, a number "N" of all unique bet combinations of 6 numbers from range 1 to 49 is calculated. A bit table with bits corresponding to each bet combination is created, as illustrated in FIG. 6. For combination 1 (e.g., 1, 2, 3, 4, 5, 6), if it was wagered, a corresponding bit number 1 is set. For combination 2 (e.g., 1, 2, 3, 4, 5, 7), if it was wagered a corresponding bit number 2 is set. Continuing for combination N (e.g., 44, 45, 46, 47, 48, 49), if it was wagered, a corresponding bit number L is set. For all non-wagered combinations corresponding bits remain not set. A number "N" of all set bits in the bit table corresponding to all wagered combinations is calculated 34. A number "k" between 1 and N is randomly generated to select the winning combination. For example, if number 1 is generated, the process looks for the first bit set in the table, which corresponds in this example to a winning combination of 1, 2, 3, 4, 5, and 6. If number "k" is generated 36, the process selects 38 the k-th bit set in the table, which corresponds in this example to a winning bet combination number R, as illustrated in FIG. 7.

In another embodiment for the generation of raffle combinations winning numbers, a file is created with all the combinations wagered. Each record in the file corresponds to each unique combination. For N records, a number between 1 and N is generated. If the number "k" is generated, for example, the k-th record in the file is designated as the winning combination.

FIG. 4 is a flowchart illustrating a traditional draw. The drawing randomly selects 42 a combination of six non-repeating numbers out of all possible combinations (e.g., for the 6/49 game, 6 numbers are randomly selected from the set of integers from 1 to 49). Those six numbers as designated 44 as representing a winning combination. This can be mechanical or an electronic drawing.

Figure 5:
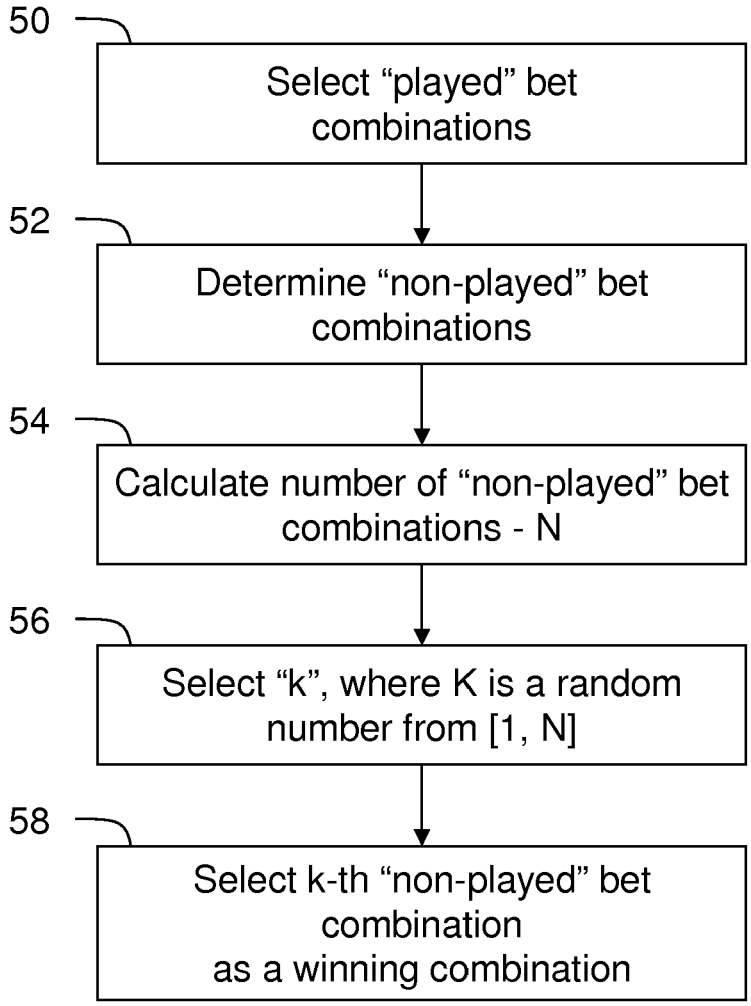
FIG. 5 is a flowchart illustrating a raffle-non-win-combination draw.

FIG. 5 is a flowchart illustrating a raffle-non-win-combination draw. One of the not wagered combinations is drawn randomly. This approach guarantees that there is no jackpot winner. This type of draw has an additional advantage of being suitable for the games that have too many winners.

Various techniques may be used for creating the raffle-non-win-combination draw. For example, in one embodiment, for the lotto game 6/49 a bit table with bits corresponding to each possible bet combination is created and a bit corresponding to each wagered combination is set 50, as illustrated in FIG. 5. For combination 1 (e.g., 1, 2, 3, 4, 5, 6) if it was wagered a corresponding bit number 1 is set, for combination 2 (e.g., 1, 2, 3, 4, 5, 7) if it was wagered a corresponding bit number 2 is set and so forth up to for combination L (e.g., 44, 45, 46, 47, 48, 49) if it was wagered a corresponding bit number L is set. For all non-wagered combinations 52 corresponding bits remain not set (non-played). A number "N" of all not wagered combinations is calculated 54 and the number "k" from the range [1, N] is randomly generated 56. A k-th not set (non-played) bit is found 58 in the bit table. This bit corresponds to the bet combination of winning numbers drawn. For example, if number 1 is generated (e.g., k=1), the first bit not set in the table is chosen. If the first not set bit is bit number 3, for example, the winning combination is 1, 2, 3, 4, 5, and 7. If the first not set bit is bit number F, the winning combination in this example is the combination number F, as illustrated in FIG. 8.

In reference to FIGS. 6, 7 and 8, the tables showing unique bet combinations played for a game for a draw or showing lists of all wagered bet combinations is referred to as a game pool. Game pools allow for learning about all wagered combinations in real time or shortly before the draw. This game pool or list of bet combinations may be created in computer memory, saved as a file on a disc, recorded in database, etc. In addition to learning all bet combinations played, the game pool complementarily allows learning information of all combinations not played. In usage, a lotto game pool could be built by enumerating all combinations possible. For example, combination 1, 2, 3, 4, 5, 6 may correspond to value 1, combination 1, 2, 3, 4, 5, 7 may correspond to value 2, and combination 1, 2, 3, 4, 5, 8 may correspond to value 3, etc.

Exemplary Game Draw Process Description

References to the figures are marked by putting "F" with the figure number, and another number representing the step, e.g. step 22 from FIG. 2 will be marked as (F2-22).

In one exemplary embodiment, for a game generating not enough winners:

1. A file or a table with bet combinations is created. (F3-32)
2. A number "N" representing a quantity of all unique bet combinations is calculated. (F3-34)
3. The bet combinations or file with transactions are digitally signed (optional).
4. A Qualified-Raffle draw is held. In a preferred embodiment, a raffle draw results in at least 15% of games (F2-2)
5. If a raffle draw is required, for N combinations, number "k" between 1 and N is randomly generated and a winning bet combination corresponding to the "k-th" bet is chosen as a winning combination. (F2-28), (F3-34, F3-36, F3-38)
6. If a non-raffle draw is required, a traditional draw for this game is held or raffle-non-win-combination draw is held. This depends on the game type and/or game requirements. (F2-30) (F4 or F5)

In one embodiment, the order of the steps, events, or operations above are done in any order. For example, a step 1, 2 and 3 may be performed after a step 4. In another embodiment, the order of the steps, events, or operations above are done in parallel.

In another exemplary embodiment, for a game generating too many winners:

1. A file or a table with bet combinations is created. (F3-32)

2. A number "N" representing a quantity of all unique bet combinations is calculated. (F3-34)

3. The bet combinations or file with transactions are digitally signed (optional).

4. A Qualified-Raffle draw is held. (F2-2)

5. If a raffle draw is required, for N combinations, number "k" between 1 and N is randomly generated and a winning bet combination corresponding to the "k-th" bet is chosen as a winning combination. (F2-28) (F3-36) (F3-38)

6. If a non-raffle draw is required, a raffle-non-win-combination draw is held. (F2-30), (F5-52, F5-54, F5-56, F5-58)

In one embodiment, the order of the steps, events, or operations above are done in any order. For example, a step 1, 2 and 3 may be performed after a step 4. In another embodiment, the order of the steps, events, or operations above are done in parallel.

In one embodiment, the various steps are performed by different physical systems, including but not limited to a system that collects transactions and a system that generates random numbers.

The numbering or sequencing of bet combinations is arbitrary and any type of numbering or sequencing schema may be used in embodiments of this invention.

Multi-Jurisdiction Games

In an alternative embodiment, the aforementioned processes apply to both single and multi-jurisdiction games such as Powerball, Viking Lotto or Euromillions. In one embodiment, multi-jurisdiction games bets from all jurisdictions are combined for draw qualification. In another embodiment, an additional process may be held to decide which jurisdiction data to use for raffle draw. The process of deciding which jurisdiction data to use for a raffle draw is referred to as "jurisdiction qualification". In one embodiment, a random number generation process is used to randomly assign jurisdiction. Probability to choose a specific jurisdiction is at least one of but not limited to a proportion of sales, a number of transactions sold, and a bet coverage in each jurisdiction. Using raffle-combination draw in the "assigned" jurisdiction guarantees that there is at least one winner in at least one jurisdiction. This methodology applies also to the standard multi-jurisdictional raffle.

Figure 9:
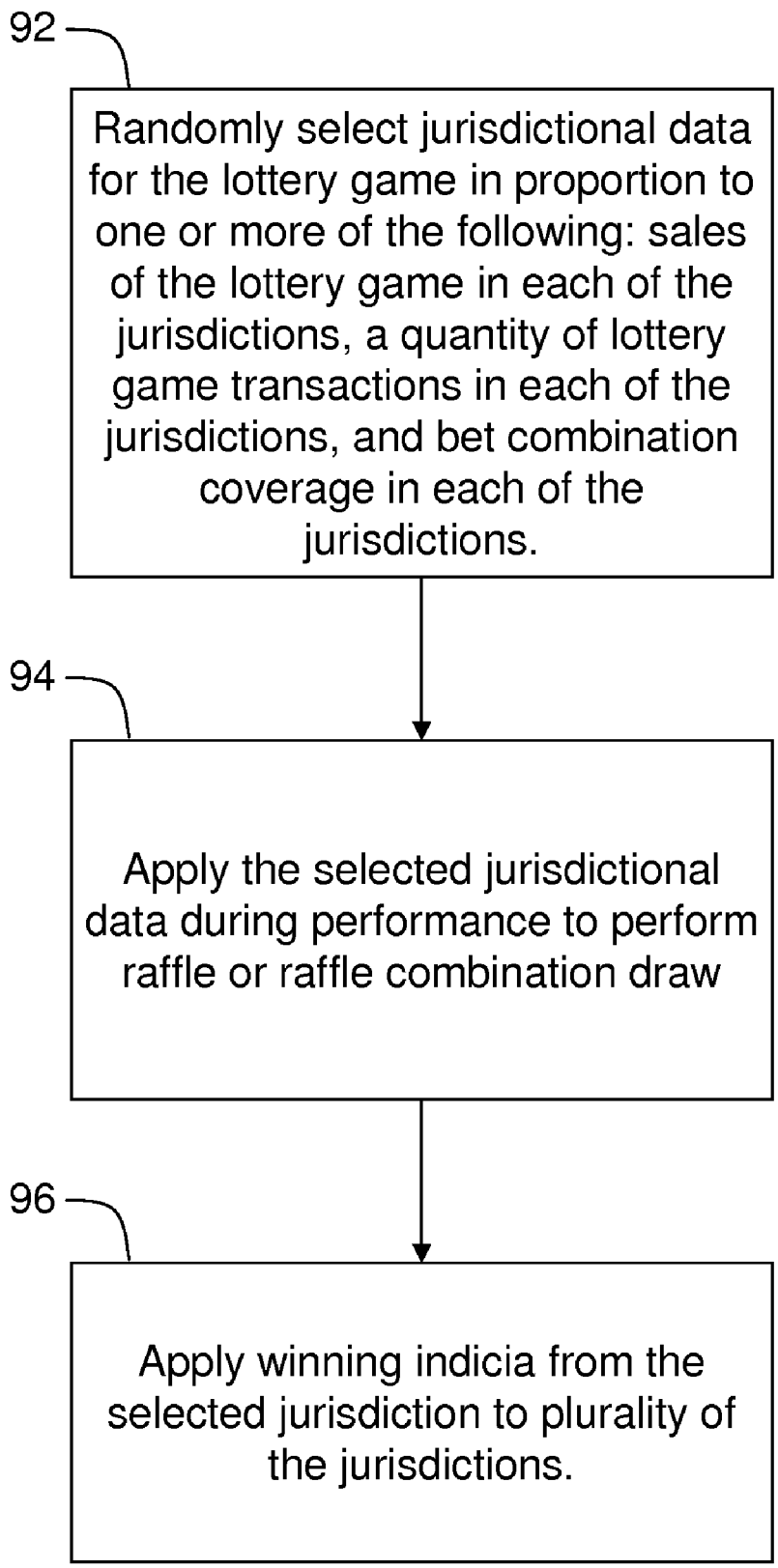
FIG. 9 is a flowchart illustrating one embodiment of a raffle-combination draw in a multi-jurisdiction lottery game.

FIG. 9 is a flowchart illustrating one embodiment of a method for conducting a raffle or raffle-combination draw in a multi-jurisdiction lottery game with the multi-jurisdiction lottery game occurring in a plurality of jurisdictions. The method includes randomly selecting 92 jurisdictional data for the lottery game in proportion to one or more of the following: sales of the lottery game in each of the jurisdictions, a quantity of lottery game transactions in each of the jurisdictions, and bet combination coverage in each of the jurisdictions. The method further includes applying 94 the selected jurisdictional data during performance to perform raffle or raffle combination draw, and applying 96 winning indicia from the selected jurisdiction to plurality of the jurisdictions.

Figure 10:
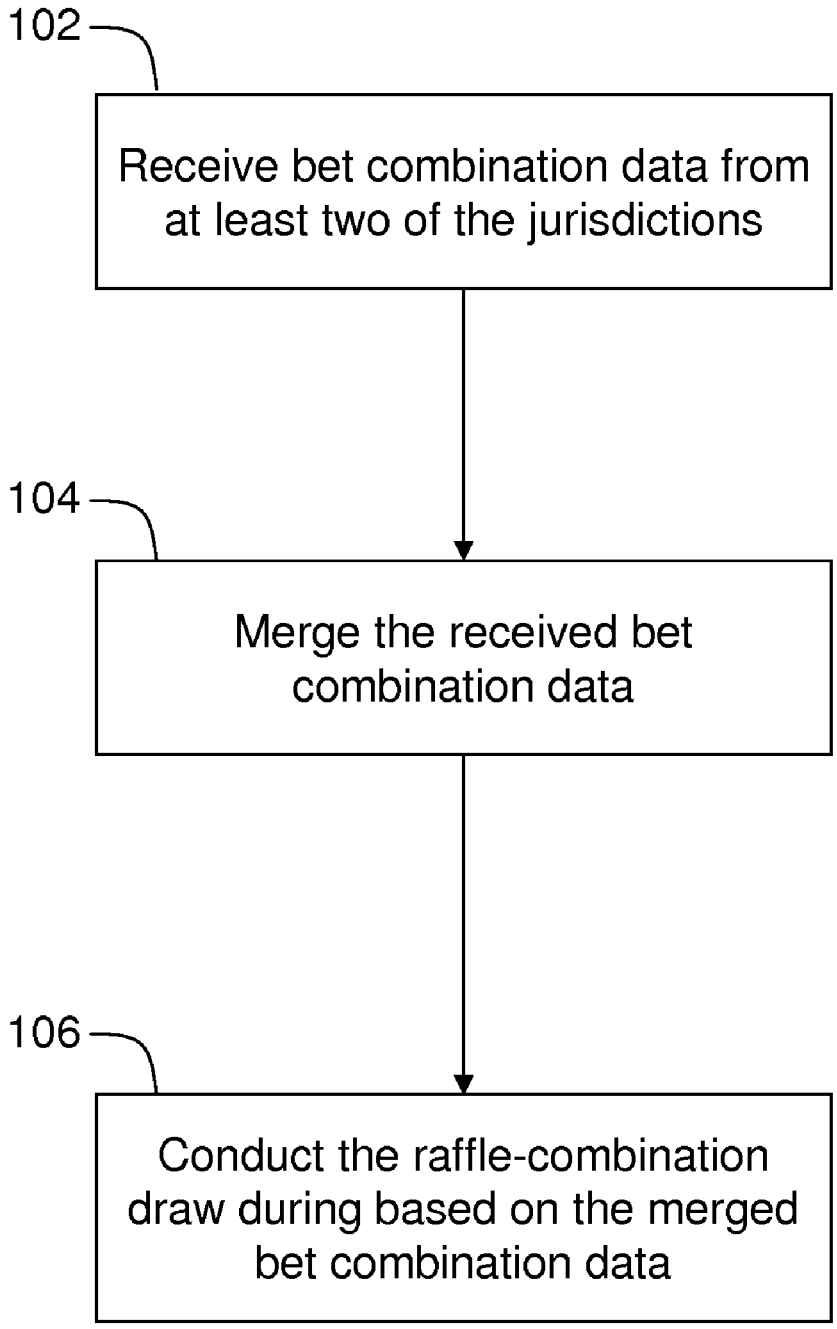
FIG. 10 is a flowchart illustrating another embodiment of a raffle-combination draw in a multi-jurisdiction lottery game.

FIG. 10 is a flowchart illustrating another embodiment of a method for conducting a raffle-combination draw in a multi-jurisdiction lottery game with the multi-jurisdiction lottery game occurring in a plurality of jurisdictions. The method includes receiving 102 bet combination data from at least two of the jurisdictions, merging 104 the received bet combination data, and conducting 106 the raffle-combination draw during based on the merged bet combination data.

Additional Embodiments

In addition to a system generating winning numbers, a complementary audit system verifying the integrity of winning numbers and draw method is another aspect of this invention. In one embodiment, an audit system or an independent third-party system receives wagered bet combinations, digital signature of bet combinations or one way hash of bet combinations prior to a draw, or bet combinations are digitally time-stamped prior or during a draw. The audit system recreates and/or verifies the steps leading to drawing the winning numbers, determines independently winning combinations and compares them with winning combinations generated by a game server.

In an alternative embodiment, the winnings for jackpot games are controlled with a variable probability. The probability may vary depending on at least one of but is not limited to game sales and game coverage. For example, the game provider may want to set the probability of winning a jackpot to 20% when the game coverage is less than 15% and for all other coverage to 25%.

Please note that while examples are provided for lotto games, this invention also applies to other lottery games such as joker numbers, multi-matrix lotto games such as Powerball, etc.

Exemplary Operating Environment

By way of example and not limitation, computer readable media comprise computer storage media and communication media. Computer storage media store information such as computer readable instructions, data structures, program modules or other data. Communication media typically embody computer readable instructions, data structures, program modules, or other data in a modulated data signal such as a carrier wave or other transport mechanism and include any information delivery media. Combinations of any of the above are also included within the scope of computer readable media.

Although described in connection with an exemplary computing system environment, embodiments of the invention are operational with numerous other general purpose or special purpose computing system environments or configurations. Examples of well known computing systems, environments, and/or configurations that may be suitable for use with aspects of the invention include, but are not limited to, mobile computing devices, personal computers, server computers, hand-held or laptop devices, multiprocessor systems, gaming consoles, microprocessor-based systems, set top boxes, programmable consumer electronics, mobile telephones, network PCs, minicomputers, mainframe computers, distributed computing environments that include any of the above systems or devices, and the like.

Embodiments of the invention may be described in the general context of computer-executable instructions, such as program modules, executed by one or more computers or other devices. The computer-executable instructions may be organized into one or more computer-executable components or modules. Generally, program modules include, but are not limited to, routines, programs, objects, components, and data structures that perform particular tasks or implement particular abstract data types. Aspects of the invention may be implemented with any number and organization of such components or modules. For example, aspects of the invention are not limited to the specific computer-executable instructions or the specific components or modules illustrated in the figures and described herein. Other embodiments of the invention may include different computer-executable instructions or components having more or less functionality than illustrated and described herein.

The order of execution or performance of the operations in embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

What is claimed is:

1. A method for conducting draws for a jackpot game comprising a plurality of possible bet combinations, said method comprising:

receiving a plurality of wagered bet combinations for the jackpot game;

identifying a plurality of draw types for the jackpot game, said plurality of draw types including two or more of the following: a traditional draw wherein any one of the plurality of possible bet combinations is selected, a raffle-combination draw wherein one or more of the plurality of wagered bet combinations are selected, and a raffle-non-win combination draw wherein one or more non-wagered bet combinations from the plurality of possible bet combinations are selected;

selecting, based at least on one or more selection criteria, a first one of the identified plurality of draw types for a first draw for the jackpot game, wherein the selected first one of the identified plurality of draw types is applied by a processor during the first draw of the jackpot game; and selecting, based at least on one or more of the selection criteria, a second one of the identified plurality of draw types for a second draw for the jackpot game, wherein the selected second one of the identified plurality of draw types is applied during the second draw of the jackpot game, wherein the first one of the draw types and the second one of the draw types correspond to the same or different draw types.

2. The method of claim 1, wherein selecting the first one of the identified plurality of draw types for the first draw for the jackpot game comprises selecting, based on an output from a random number generator according to a pre-determined probability, the first one of the identified plurality of draw types for the first draw for the jackpot game.

3. The method of claim 2, wherein predetermined probability to choose a draw type is variable and dependent on one or more of the following: a predetermined sales level and a predetermined bets coverage.

4. The method of claim 1, wherein selecting the first one of the identified plurality of draw types for the first draw for the jackpot game comprises selecting, based on a predetermined frequency of each of the plurality of draw types, the first one of the identified plurality of draw types for the first draw for the jackpot game.

5. The method of claim 1, wherein selecting the first one of the identified plurality of draw types for the first draw for the jackpot game comprises selecting, based on a predetermined winnings frequency, the first one of the identified plurality of draw types for the first draw for the jackpot game.

6. The method of claim 1, further comprising receiving data including a combinations bet prior to the first draw or the second draw.

7. The method of claim 1, wherein selecting the first one of the identified plurality of draw types for the first draw for the jackpot game comprises selecting, based on input from a game organizer, the first one of the identified plurality of draw types for the first draw for the jackpot game.

8. The method of claim 1, wherein selecting the first one of the identified plurality of draw types for the first draw for the jackpot game comprises selecting the first one of the identified plurality of draw types based on one or more of the following: a predetermined jackpot frequency, a predetermined jackpot size, and a predetermined marketing need.

9. The method of claim 1, wherein selecting the first one of the identified plurality of draw types for the first draw for the jackpot game comprises selecting, based on a result of a sporting event or gaming event, the first one of the identified plurality of draw types for the first draw for the jackpot game.

10. The method of claim 1, wherein selecting the second one comprises selecting the second one of the identified plurality of draw types for a next draw.

11. The method of claim 1, wherein selecting the second one comprises selecting the second one of the identified plurality of draw types for a subsequent independent draw.

12. The method of claim 1, wherein selecting the first one of the draw types occurs simultaneously with selecting the second one of the draw types.

13. The method of claim 1, wherein selecting the second one of the draw types occurs subsequently to selecting the first one of the draw types.

14. The method of claim 1, wherein selecting the first one of the identified plurality of draw types for the first draw for the jackpot game comprises selecting the first one of the identified plurality of draw types based on one or more of the following: a predetermined bets coverage and a predetermined sales level.

15. A system for conducting draws for a jackpot game, said system comprising:

a memory area for storing a plurality of draw types for the jackpot game, the jackpot game comprising a plurality of possible bet combinations, said plurality of draw types including two or more of the following: a traditional draw wherein any one of the possible bet combinations is selected, a raffle-combination draw wherein one or more wagered bet combinations from the plurality of possible bet combinations are selected, and a raffle-non-win combination draw wherein one or more non-wagered bet combinations from the plurality of possible bet combinations are selected; and a processor configured to:

select, based at least on one or more selection criteria, a first one of the identified plurality of draw types for a first draw for the jackpot game, wherein the selected first one of the identified plurality of draw types is applied during the first draw of the jackpot game; and select, based at least on one or more of the selection criteria, a second one of the identified plurality of draw types for a second draw for the jackpot game, wherein the selected second one of the identified plurality of draw types is applied during the second draw of the jackpot game, wherein the first one and the second one correspond to the same or different draw types.

16. The system of claim 15, wherein the selection criteria comprises one or more of the following:

an output from a random number generator according to a pre-determined probability, a predetermined frequency of each of the plurality of draw types, a predetermined winnings frequency, a predetermined sales level, a predetermined bet combinations coverage, input from a game organizer, a predetermined jackpot size, a predetermined marketing need, and a result of a sporting event or gaming event.

17. A method for conducting a raffle or raffle-combination draw in a multi-jurisdiction lottery game, said multi-jurisdiction lottery game occurring in a plurality of jurisdictions, said method comprising:

randomly selecting, by a processor, jurisdictional data for the lottery game in proportion to one or more of the following: sales of the lottery game in each of the jurisdictions, a quantity of lottery game transactions in each of the jurisdictions, and bet combination coverage in each of the jurisdictions; and applying the selected jurisdictional data during performance to perform raffle or raffle combination draw; and applying winning indicia from the selected jurisdiction to plurality of the jurisdictions.

18. A method for conducting a raffle-combination draw in a multi-jurisdiction lottery game, said multi-jurisdiction lottery game occurring in a plurality of jurisdictions, said method comprising:

receiving bet combination data from at least two of the jurisdictions;

merging the received bet combination data; and conducting, by a processor, the raffle-combination draw during based on the merged bet combination data.

* * * * *